US005111666A

United States Patent [19]

Klok et al.

[11] Patent Number: 5,111,666

[45] Date of Patent: May 12, 1992

[54] HOLDING CONTAINER FOR CRYOGENIC LIQUID

[75] Inventors: Cornelis Klok, Noiseau; Daniel Delatte, Saint Maur, all of France

[73] Assignee: L'Air Liquide, Societe Anonyme pour l'Etude et l'Exploitation des Procedes Georges Claude, Paris, France

[21] Appl. No.: 609,761

[22] Filed: Nov. 7, 1990

[30] Foreign Application Priority Data

Dec. 1, 1989 [FR] France ..... 89 15843

[51] Int. Cl.[5] ..... F17C 3/08; F17C 7/04; F17C 13/00

[52] U.S. Cl. ..... 62/48.1; 62/45.1; 62/50.2; 62/465

[58] Field of Search ..... 62/45.1, 47.1, 48.1, 62/50.2, 50.7, 50.4, 383, 465, 45.4

[56] References Cited

U.S. PATENT DOCUMENTS

| | | | |
|---|---|---|---|
| 3,721,101 | 3/1973 | Sheppard et al. | 62/55.5 X |
| 4,674,289 | 6/1987 | Andonian | 62/47.1 |
| 4,918,927 | 4/1990 | Eegenbrod | 62/45.1 |
| 4,944,155 | 7/1990 | Alexander | 62/45.1 |
| 4,947,651 | 8/1990 | Neeser et al. | 62/50.4 |

FOREIGN PATENT DOCUMENTS

| | | | |
|---|---|---|---|
| 0098030 | 1/1984 | European Pat. Off. . | |
| 0098766 | 1/1984 | European Pat. Off. . | |
| 0056698 | 3/1987 | Japan | 62/50.4 |
| 1014583 | 12/1965 | United Kingdom . | |

*Primary Examiner*—Henry A. Bennet
*Assistant Examiner*—Christopher B. Kilner
*Attorney, Agent, or Firm*—Young & Thompson

[57] ABSTRACT

The holding container comprises an inner casing and an outer casing of the same or different materials and a cryogenic liquid withdrawing pipe including an inner portion having a section advantageously in the form of adjacent spiral turns, which is kept in resilient contact, typically by means of a spring spacer against the inner face of the other casing, thus enabling to provide heat exchange contact between the section of the first part of the pipe and the outer casing notwithstanding the nature of the materials constituting the pipe and the outer casing. Application for example to self-pressurizable holding containers.

14 Claims, 2 Drawing Sheets

HOLDING CONTAINER FOR CRYOGENIC LIQUID

BACKGROUND OF INVENTION (1.) Field of the Invention

The present invention concerns holding containers for cryogenic liquids of the type comprising an inner casing and an outer casing defining an insulating inner space therebetween and a cryogenic liquid withdrawing pipe in the inner casing including a first portion extending into the inner space between a lower portion of the inner casing and an upper portion of the outer casing, for example, holding containers for distributing liquid nitrogen in particular, which are made self-pressurizable by means of said withdrawing pipe.

(2.) Description of Prior Art

In order to provide a gaseous phase at the outlet of a cryogenic liquid withdrawing pipe, the first portion, or internal portion of the pipe includes a section which is in heat exchange contact with the outer casing at least partially to vaporize the liquid which is withdrawn from the inner casing. Depending on the materials of which the outer casing and the pipe are made, joining of the section and the outer casing by brazing, welding or gluing would cause certain problems, for example deformation of the outer casing, and significantly increases the manufacturing cost.

SUMMARY OF INVENTION

It is an object of the present invention to provide a holding container for cryogenic liquid of rugged and simplified construction, of reduced manufacturing cost and enabling a large scale of choice of materials of the constitutive elements depending on needs and uses.

For this purpose, according to a characteristic of the invention, the first portion of the pipe includes a section which is kept in resilient contact against the inner face of the outer casing. Typically, this section comprises at least one spiral turn, resilient means cooperating with the spiral turn to tend to produce a radial opening of the latter and therefore to keep it applied against the outer casing.

With such an arrangement, heat exchange contact is maintained notwithstanding the materials with which the pipe and the outer casing are made, and this arrangement enables to highly limit the transmission of shocks or vibrations between the outer casing and the inner casing therefore ensuring an increased life to the holding container.

According to another characteristic of the invention, if for example for considerations of total weight, the withdrawing pipe is made of a light alloy, for example, of aluminum, care should be exercised with such materials that are good heat conductors, to limit heat losses by direct conductivity between the inner casing and the outer casing. For this purpose, according to another characteristic of the invention, the first portion of the withdrawing pipe is connected to an end portion by means of a section of a material with lesser heat conductivity, for example a plastic material.

BRIEF DESCRIPTION OF DRAWINGS

Other characteristics and advantages of the present invention will appear from the description which follows of an embodiment given by way of illustration without limitation, with reference to the annexed drawings in which.

Figure 1:
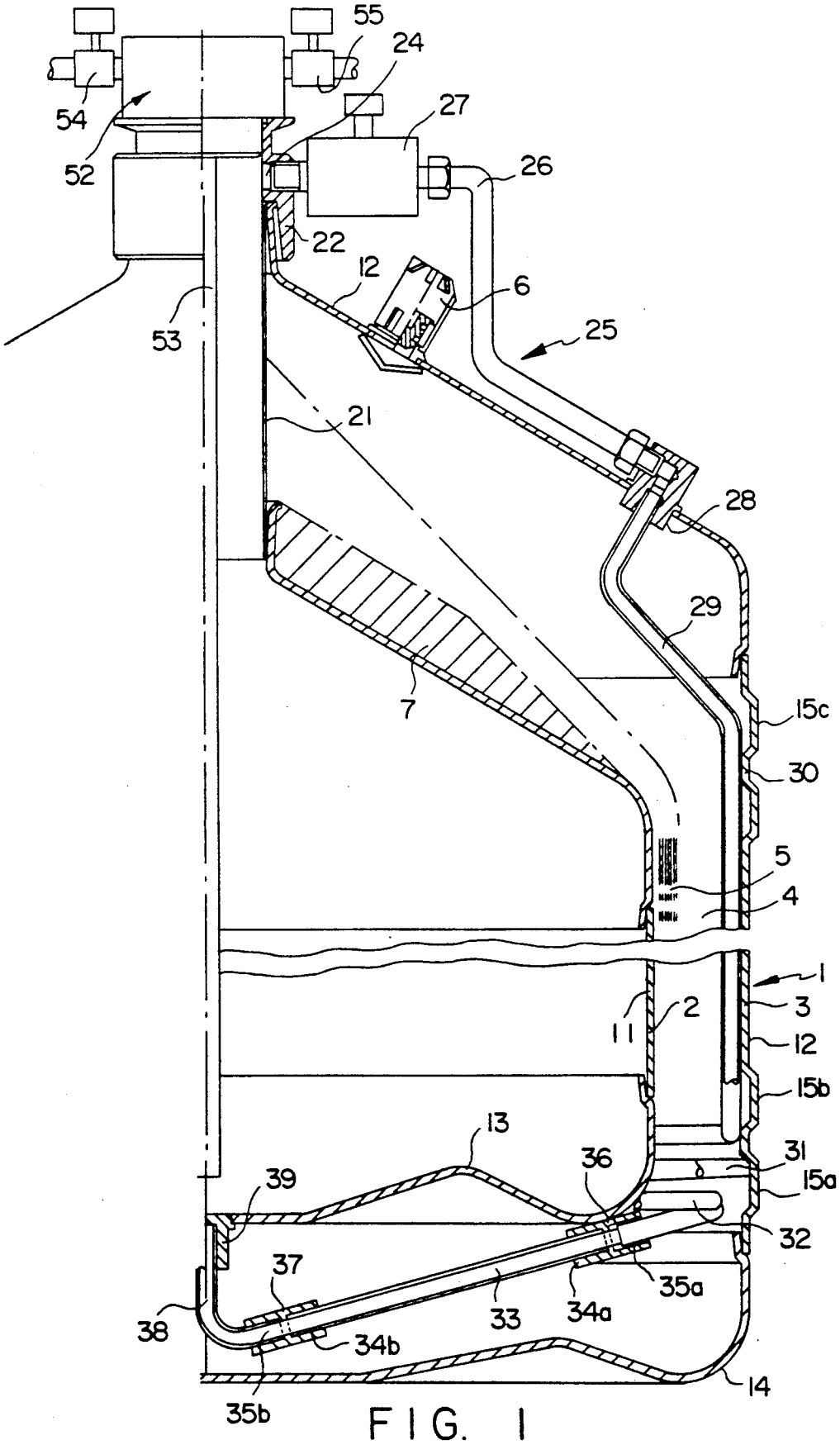
FIG. 1 is a schematic view in half longitudinal cross-section of a self-pressurizable cryogenic holding container according to the invention.

There is illustrated in FIG. 1 a cryogenic container 1 of the self-pressurizable type for the distribution of liquid nitrogen, comprising in known manner an inner casing 2 constituting a holding container for the cryogenic liquid, and an outer casing 3 spaced from the casing 2 to provide an inner space 4 therebetween enabling to provide a multilayer insulation 5 applied against the inner casing 2, the inner space 4 being placed under vacuum by suction through a closeable connector 6. An adsorbing product 7 is advantageously placed in the inner space 4 to catch residual gases that may be present.

In the embodiment illustrated in FIG. 1, the inner casing 2 and the outer casing 3 are both made of aluminum starting from a sleeve 11, 12 and a bottom 13, 14 respectively mounted thereon by welding. The sleeve 12 of the outer casing 3 is advantageously provided with reinforcing ribs 15*a*, 15*b*, 15*c*.

Also in known manner, the holding container comprises a neck 21, typically formed of a tubular element of fiberglass reinforced epoxy resin, which is glued in neck portions of reduced diameter of casings 2 and 3 and joined at the end for example by gluing to a solid element of aluminum 22 having an upper face enabling to receive a plug and a radial duct 24 defining the downstream end of a pressurizing circuit 25 comprising an outer pipe 26 provided with a valve 27 extending between the inlet 24 and a nipple connector 28 of the outer casing 3. The pressurizing circuit comprises an internal part 29, extending into the inner space 4 from the connector 28 to the lower zone of the holding container by first running along, at 30, an internal generating line of the outer casing 3 and providing, in the vicinity of the bottom of the holding container, at least two spiral turns 31, 32, advantageously disposed in one of the ribs (15*a*) of the outer casing, and which are maintained permanently resiliently pressed against the inner face of the outer casing as will be seen later. If, as illustrated in the example, pipe 29 is made of a material with a good heat conductivity, for example aluminum, the lower end of the pipe portion 29 is connected to a tubular section 33 of a material having a low heat conductivity, for example a plastic material such as a fiberglass reinforced epoxy resin, whose both ends are respectively fixed in a nipple connector 36 to pipe 29 and to nipple connector 37 at a curved end section 38, which itself is connected to a connector 39 which is unitary with the bottom 13 of the inner casing 2.

Figure 2:
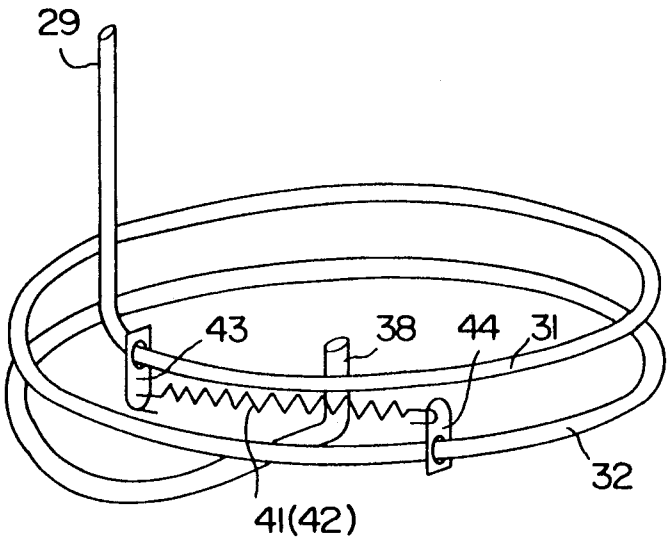
FIG. 2 is a perspective view of the contact section of the first portion of the withdrawing pipe of the holding container of FIG. 1.

As better illustrated in FIG. 2, the application under pressure of each spiral turn 31, 32 against the inner face of the outer casing 3 is ensured by at least one resilient spring 41, 42, acting between opposed portions of the spiral turn so as to have a tendency to provide a radial opening of the latter, the anchoring of the ends of the spring on one spiral turn being ensured by self-blocking studs 43, 44.

To use the cryogenic container which has just been described, instead of a plug used for obturation during transportation and storage, there is mounted a tapping device 52 including a dipping tube 53 extending to the vicinity of the bottom of the inner casing 2 and which frees the radial duct 24 towards the gaseous atmosphere of the inner casing 2. To pressurize the holding container, it is then sufficient to open valve 27, which permits to inject gas under pressure withdrawn by circuit 25 into the gaseous atmosphere of the container. The withdrawn cryogenic liquid is then vaporized upon contact with the outer casing 3 at the level of the spiral turns 31 and 32. The withdrawing device 52 additionally comprises a valve 54 for withdrawing cryogenic liquid from the inner casing 2 via dipping tube 53.

In the embodiment represented in FIG. 1, the outer casing 3, the inner casing 2 and the pipe portion 29, and the final section 38 are made of aluminum, the pipe sections being sealingly connected to the connectors 28, 36 and 37 by gluing. As a variant, the pipe portion 29 can be made of stainless steel in which case the tubular section of insulating material 33 can be removed, the stainless steel tube being fixedly mounted on the connectors 28 and 39 by gluing or brazing. Instead of the tubular portion 29 of aluminum, a tubular portion of copper may also be used, which also requires the use of the insulating section 33. Also as a variant, at least the inner casing, as well as advantageously the withdrawing tube may be made of stainless steel. Finally, the holding container according to the invention enables to produce the inner and outer casings as well as the withdrawing tube of plastic material, for example of fiberglass reinforced epoxy resin or polycarbonate.

We claim:

1. Holding container for cryogenic liquid comprising an inner casing (2) and an outer casing (3) defining an inner space (4) therebetween and a cryogenic liquid withdrawing pipe connected to said inner casing and including a first portion (29) extending into the inner space (4), wherein the pipe (29) includes a section (31, 32) in resilient contact against the inner face of the outer casing (3), the pipe section comprising at least one spiral turn (31, 32) and resilient means (42, 41) cooperating with the spiral turn to induce a radial opening of the spiral turn.

2. Holding container according to claim 1 wherein the resilient means comprise at least one spring (41; 42) acting between opposed portions of the spiral turn (31, 32).

3. Holding container according to claim 2, wherein the spring (41;42) is unitary with the spiral turn (31,32) by means of self blocking studs (43,44).

4. Holding container according to claim 1, wherein at least one spiral turn (31,32) is at least partially received in a reinforcing rib (15*a*) of the outer casing (3).

5. Holding container according to claim 1, wherein the inner (2) and outer (3) casings are made of the same material.

6. Holding container according to claim 1, wherein the inner (2) and outer (3) casings are made of different materials.

7. Holding container according to claim 5, wherein the first pipe portion (29) is made of the same material as the inner (2) and outer (3) casings.

8. Holding container according to claim 6, wherein the first pipe portion (29) is made of a different material than the material of the outer casing (3).

9. Holding container according to claim 1, wherein at least the outer casing (3) is made of a light alloy.

10. Holding container according to claim 1, wherein the first pipe portion (29) is made of a material having a good heat conductivity and is connected to an upstream end portion (38) by means of a section (33) of a material which has lesser heat conductivity.

11. Holding container according to claim 1, wherein the withdrawing pipe comprises a second portion (26) connected to the neck (21) of the inner casing to constitute a pressurizing circuit of the container.

12. A container for storing liquefied gas, comprising an inner casing having a bottom portion and an outer casing having a sidewall, the inner casing and the outer casing defining therebetween an inner space, a liquefied gas withdrawing pipe connected to said inner casing and having a first portion extending into the inner space and forming at least one spiral turn, and resilient means biasing the spiral turn for widening out the spiral turn and causing the spiral turn to stay in contact engagement with the sidewall of the outer casing.

13. The container of claim 12, wherein the resilient means are supported by the first portion of the pipe.

14. The container of claim 12, wherein the pipe includes at least a second portion in the inner space, adjacent the bottom portion of the inner casing and made of a material having lower heat conductivity than said first portion.

* * * * *